US009238929B2

(12) United States Patent
Cho et al.

(10) Patent No.: US 9,238,929 B2
(45) Date of Patent: Jan. 19, 2016

(54) DOOR LOCKING APPARATUS AND AN ENCLOSURE HAVING THE SAME

(71) Applicant: LG N-Sys Inc., Seoul (KR)

(72) Inventors: Woo Youn Cho, Seoul (KR); Se Hoon Park, Gyeonggi-do (KR); Jae Sung Yeon, Seoul (KR); Jang Wook Choi, Seoul (KR); Kwang Hun Ko, Gyeonggi-do (KR); Sung Yong Oh, Seoul (KR)

(73) Assignee: LG N-SYS, INC., Seoul (KR)

( * ) Notice: Subject to any disclaimer, the term of this patent is extended or adjusted under 35 U.S.C. 154(b) by 199 days.

(21) Appl. No.: 13/722,284

(22) Filed: Dec. 20, 2012

(65) Prior Publication Data

US 2013/0154462 A1 Jun. 20, 2013

(30) Foreign Application Priority Data

Dec. 20, 2011 (KR) ..... 10-2011-0138366
Dec. 20, 2011 (KR) ..... 10-2011-0138367
Oct. 19, 2012 (KR) ..... 10-2012-0116642

(51) Int. Cl.
*E05G 1/04* (2006.01)
*E05B 65/00* (2006.01)
*E06B 3/36* (2006.01)

(52) U.S. Cl.
CPC ..... *E05B 65/0082* (2013.01); *E06B 3/36* (2013.01); *E05G 1/04* (2013.01); *Y10T 70/20* (2015.04)

(58) Field of Classification Search
CPC ..... E05C 19/184; E05C 1/04; E05C 19/003; E05C 1/06; E05C 1/10; E05C 9/041; E05B 63/14; E05B 17/2084; E05B 17/2092; E05B 1/023; E05B 55/12; E05B 63/12; E05B 65/0082; E05B 17/2015
USPC ..... 70/1.5, 416, 118–120, 129, 130, 133, 70/134, 136, 150, 151 R, 151 A, 153; 109/59 R; 292/340, 341.12, 341.11, 292/341.13, 346
See application file for complete search history.

(56) References Cited

U.S. PATENT DOCUMENTS 3,669,481 A * 6/1972 Bergmann ..... 292/49
4,194,776 A * 3/1980 Biebuyck ..... 292/346
4,245,567 A * 1/1981 Herrmann ..... 109/64
4,679,415 A * 7/1987 Spratt ..... 70/118
4,712,393 A * 12/1987 Deschamps et al. ..... 70/1.5
5,121,950 A * 6/1992 Davidian ..... 292/164
5,473,922 A * 12/1995 Bair et al. ..... 70/416
5,942,973 A * 8/1999 Lee ..... 340/542
6,089,168 A * 7/2000 Dunlap et al. ..... 109/59 R
6,679,087 B2 * 1/2004 Suggs et al. ..... 70/153
6,722,711 B2 * 4/2004 Kitzis ..... 292/145
6,786,519 B2 * 9/2004 Gartner ..... 292/195

(Continued)

FOREIGN PATENT DOCUMENTS

JP 2009-019380 A 1/2009
KR 20-2000-0005499 A 3/2000

*Primary Examiner* — Suzanne Barrett
(74) *Attorney, Agent, or Firm* — Saliwanchik, Lloyd & Eisenschenk

(57) ABSTRACT

A door locking apparatus and an enclosure comprising the same are disclosed. The door locking apparatus comprises an operation unit 52 installed on a door 30 for opening/closing a body frame 10, and one or more locking units 80 installed in the door 30 to be capable of being inserted into or released from a locking hole 11 formed in the body frame 30. At least one of the locking units 80 comprises an unlocking restraint module 83, 84 operated by an external force and caught by the body frame 10.

19 Claims, 12 Drawing Sheets

(56) References Cited

U.S. PATENT DOCUMENTS

| | | | | |
|---|---|---|---|---|
| 6,910,357 | B2 * | 6/2005 | Hirvi | 70/422 |
| 6,997,487 | B2 * | 2/2006 | Kitzis | 292/1 |
| 7,100,406 | B2 * | 9/2006 | Masseth, Jr. | 70/210 |
| 8,479,543 | B2 * | 7/2013 | Yang et al. | 70/118 |
| 2008/0276672 | A1 * | 11/2008 | Gartner | 70/277 |
| 2013/0042657 | A1 * | 2/2013 | Dehaven et al. | 70/1.5 |
| 2014/0260446 | A1 * | 9/2014 | Lila | 70/134 |
| 2014/0265367 | A1 * | 9/2014 | Lila | 292/253 |

* cited by examiner

DOOR LOCKING APPARATUS AND AN ENCLOSURE HAVING THE SAME

CROSS-REFERENCE TO RELATED APPLICATIONS

This application claims the benefit under 35 U.S.C. §119 of Korean Patent Application Nos. 10-2011-0138366, filed Dec. 20, 2011; 10-2011-0138367, filed Dec. 20, 2011; and 10-2012-0116642, filed Oct. 19, 2012, which are hereby incorporated by reference in their entirety.

BACKGROUND

The present disclosure relates to a door locking apparatus and an enclosure having the same.

An enclosure widely used at home or in an office to keep valuables, such as bills, marketable securities, and jewelry, are safes. In addition, automatic medium processing systems are also widely used as a kind of enclosure to keep handled bills and marketable securities therein.

An enclosure, such as a safe or an automatic medium processing system, has a body frame in which an accommodation space is formed, and a door installed to open or close the accommodation space. Here, due to the nature of the enclosure, such as the safe or the automatic medium processing system, it is important to design a door for the enclosure such that it is capable of maintaining a locked state securely in the event of an attack by a thief or a robber in order to inhibit the loss of the valuables kept in the enclosure.

For this purpose, a door of the security enclosure, such as the automatic medium processing system or a safe, is provided with locks that are locked or unlocked by keys. In addition, a structure coupled the door to the main body of the enclosure is also provided in addition to the locks.

For example, when a door handle type operation unit is rotated in a state in which the door is unlocked by a key, a locking unit inserted into a locking hole formed in a body frame is released from the inserted state, thereby allowing the door to be opened. That is, the door is configured such that the practical locking state of the door is kept by the locking unit inserted into the locking hole, and the operation of the operation unit to release the locking unit from the inserted state is allowed by an operation of the key.

However, thieves or robbers frequently attempt to forcibly open the door by targeting a gap between the door and the door frame using various tools, or destroying a locking structure for locking the door to the body frame by applying a strong external force using, for example, a hammer. For example, attempts are made to open an enclosure by forcibly moving the door and the body frame in a direction of releasing the locking unit inserted into a locking hole using tools through a gap between the door and the door frame, or by applying a strong external force from the outside of the keeling apparatus using, for example, a hammer to forcibly release the locking unit from the inserted state.

Accordingly, what is demanded in the field of enclosures, such as safe or automatic medium processing system, is a technology for inhibiting a door of an enclosure, such as a safe or an automatic medium processing system, from being opened by applying an external force through the gap of the door and body frame of the enclosure or by applying a strong external force using, for example, a hammer.

BRIEF SUMMARY

Embodiments provide a locking apparatus and an enclosure having the same.

In one embodiment: an operation unit installed on a door for opening/closing a body frame; and at least one locking unit for locking or unlocking the door, and installed in the door to be capable of being inserted into or released from a locking hole formed in the body frame according to an operation of the operation unit, wherein when plural locking units are provided, at least one of the locking units comprises an unlocking restraint module is caught by the body frame by an external force.

In another embodiment: an operation unit installed on a door for opening/closing a body frame; a locking plate installed in the door to be movable according to an operation of the operation unit between a locked position where the door is locked and an unlocked position where the door is unlocked; and at least one locking unit installed on the locking plate, and inserted into a locking hole formed in the locking plate in a locked position of the locking plate and released from the locking hole in an unlocked position of the locking plate, wherein when plural locking units are provided, at least one of the locking units comprises an unlocking restraint module restraining the movement of the locking plate in an unlocking direction when the locking unit is moved in the unlocking direction.

The details of one or more embodiments are set forth in the accompanying drawings and the description below. Other features will be apparent from the description and drawings, and from the claims.

DETAILED DESCRIPTION

Figure 1:
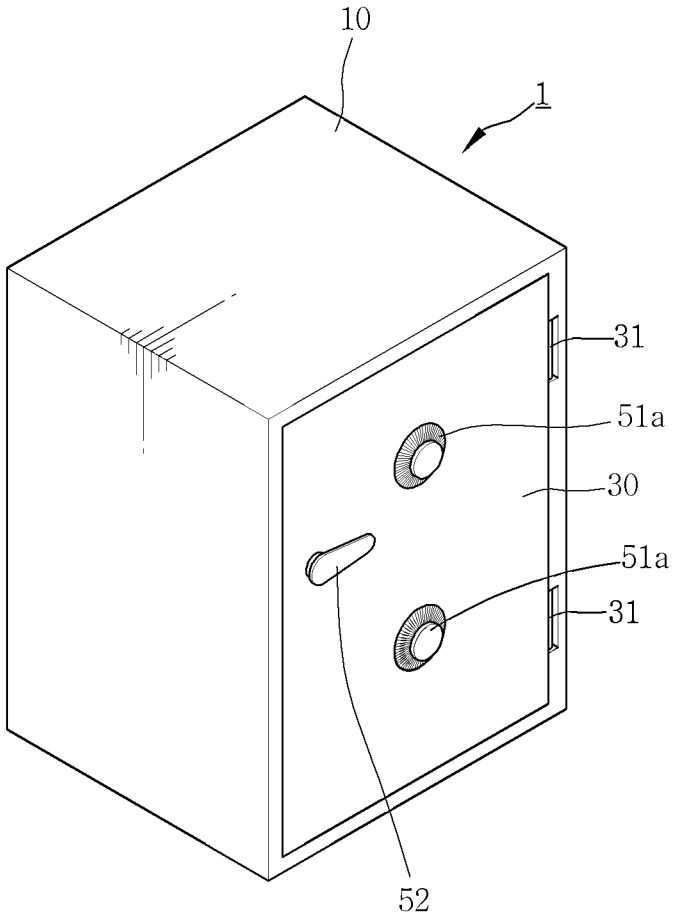
FIG. 1 is a perspective view of an enclosure according to an embodiment.

Hereinafter, embodiments will be described with reference to illustrative drawings. In the following description, the same elements will be designated by the same reference numerals although they are shown in different drawings if possible. Further, in the following description of the embodiments, a detailed description of known functions and configurations incorporated herein will be omitted when it may make the subject matter of the embodiments rather unclear.

In addition, terms, such as first, second, A, B, (a), (b) or the like may be used herein when describing components of the embodiments. Each of these terminologies is not used to define an essence, order or sequence of a corresponding component but used merely to distinguish the corresponding component from other component(s). It should be noted that if it is described in the specification that one component is "connected," "coupled" or "joined" to another component, a third component may be "connected," "coupled," and "joined" between the first and second components, although the first component may be directly connected, coupled or joined to the second component.

Furthermore, the term, "external force" used in describing embodiments means the external force applied by a thief or a robber using various tools, for example, a hammer, to forcibly move a locking unit 80, 180 or 160*a* in an unlocking direction. The external force shall not be construed as a force transmitted between components that form the inventive door locking apparatus and/or the inventive enclosure 1 or 1*a* for the purpose of a usual operation, for example, a movement in the locking direction or unlocking direction of the locking unit 80, 180 or 160*a*.

A Door Locking Apparatus According to the First Embodiment

Figure 2:
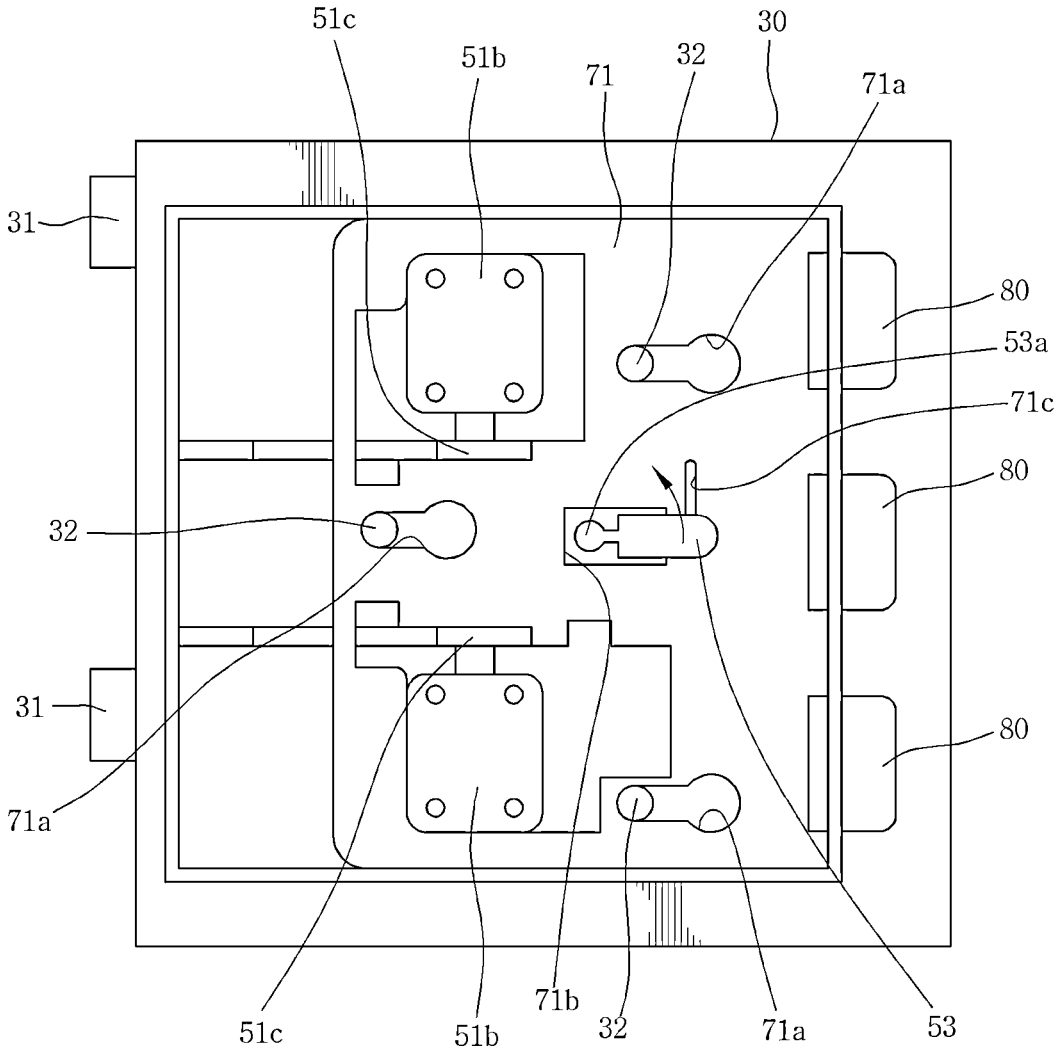
FIG. 2 is a front view illustrating the inner side of a door which is provided with the door locking apparatus according to a first embodiment.

FIG. 1 is a perspective view of an enclosure 1 according to a first embodiment, and FIG. 2 is a front view illustrating the inner side of a door 30 which is provided with a door locking apparatus according to the first embodiment.

In the present embodiment, the enclosure 1 is provided as a safe type as illustrated in FIG. 1. However, it is natural that the technical idea of the first embodiment also comprises another type of an enclosure 1, for example, an automatic medium processing system that is formed with an accommodation space in the inside thereof to be opened or closed by a door 30, and the door 30 is locked or unlocked by the door locking apparatus according to the present embodiment.

Referring to FIGS. 1 and 2, the enclosure 1 according to the first embodiment comprises: a body frame 10 which is formed with an accommodation space (not depicted) in the inside thereof, a door 30 rotatably coupled to the body frame 10 to open/close the accommodation space of the body frame 10, and a door locking apparatus locking or unlocking the door 30 in relation to the body frame 10. For example, the door 30 may be rotatably coupled to the body frame 10 by a hinge structure, for example, hinges 31 as illustrated in FIGS. 1 and 2.

The door locking apparatus according to the first embodiment is installed in the door 30 to lock or unlock the door 30 in the state where the door 30 closes the body frame 10. Here, the door locking apparatus according to the first embodiment may comprise at least one operation unit 52 and at least one locking unit 80.

An operation unit 52 is installed on the outer side of the door 30. The locking unit 80 is installed on the door 30 to be capable of being inserted into or released from a locking hole 11 (see FIG. 4*a*) to lock or unlock the door 30 according to the operation of the operation unit 52.

As illustrated in FIG. 2, in the present embodiment, the operation of the operation unit 52 is transmitted to the locking unit 80 through a locking plate 71.

More specifically, the operation unit 52 is operated by a user in such a manner that the operation unit 52 reciprocates the locking plate 71 between a locked position and an unlocked position in the state where the operation unit 52 is installed on the outer side of the door 30. In the present embodiment, the operation unit 52 is formed in a door handle shape as illustrated in FIG. 1, so that the user grasps and rotates the operation unit 52 forward or rearward. That is, when the user rotates the operation unit 52 in one direction, the locking plate 71 is moved to the locked position. To the contrary, when the user rotates operation unit 52 in the opposite direction, the locking plate 71 is moved to the unlocked position.

As described above, the locking plate 71 is installed in the inside of the door 30 to move between the locked position where the door 30 is locked and the unlocked position where the door 30 is unlocked according to the operation of the operation unit 52.

Herein below, an example of a construction that enables the locking plate 71 to be moved between the locked position and the unlocked position according to the operation of the operation unit 52 in the door locking apparatus according to the present embodiment will be described with reference to FIG. 2. Of course, the construction for moving the locking plate 71 to be described later is merely an embodiment, and the technical idea of the first embodiment is not limited thereto.

In the present embodiment, the operation unit 52 is connected with an operation lever 53 installed in the inside of the door 30 through a rotation transmission shaft unit 53*a* installed through the door 30, as illustrated in FIG. 2. With this construction, the rotation of the operation unit 52 is transmitted as the rotation of the operation lever 53 in the inside of the door 30 through the rotation transmission shaft unit 53*a*.

Here, on a surface of the locking plate 71, a movement guide slot 71*c* is formed in a direction crossing the moving direction of the locking plate 71. In addition, a guide unit (not depicted) connected with the operation lever 53 is inserted into the movement guide slot 71*c*.

With this construction, when the user rotates the operation unit 52 in the outside of the door 30, the rotation of the operation unit 52 is transmitted to the operation lever 53 through the rotation transmission shaft unit 53*a*, which in turn rotates in the direction indicated by an arrow in FIG. 2. Also, the guide unit connected to the operation lever 53 is moved along the circumferential direction of the operation lever 53 according to the rotation of the operation lever 53. In that event, the guide unit inserted into the movement guide slot 71*c* pushes an inner diameter portion of the movement guide slot 71*c* in the unlocking direction, so that the locking plate 71 is moved in the unlocking direction.

Likewise, when the locking plate 71 is moved from the unlocked position to the locked position, the individual components will be operated in a direction opposite to that in the operating process from the locked position to the unlocked position as described above.

Here, the locking plate 71 is guided by a guide frame installed in the inside of the door 30 to be moved between the locked position and the unlocked position. In addition, the locking plate 71 is formed with a plurality of guide holes 71*a*, for example, three guide holes 71*a* as illustrated in FIG. 2 along the moving direction of the locking plate 71, and guide protrusions 32 protruding from the inner surface of the door 30 are inserted into the guide holes 71*a*, thereby guiding the movement of the locking plate 71 more stably.

As described above, at least one locking unit 80 is installed on the locking plate 71. In the present embodiment, although it is exemplified that three locking units 80 are arranged to be spaced apart from each other by a predetermined interval and installed on the locking plate 71 as illustrated in FIG. 2, it is obvious that the technical idea of the first embodiment is not limited to the number.

Here, the locking unit 80 is inserted into the locking hole 11 formed in the body frame 10 in the locked position of the locking plate 71, thereby causing the door 30 to be locked to the body frame 10. In addition, the locking unit 80 is released from the locking hole 11 in the unlocked position of the locking plate 71, thereby allowing the door 30 to be opened in relation to the body frame 10.

For an example, the door locking apparatus according to the first embodiment comprises a pair of locking modules 51*b* for locking and unlocking the locking plate 71. As illustrated in FIG. 1, a pair of dial operation units Ma are installed on the front side of the door 30, and a pair of locking modules 51*b* are installed on the inner side of the door 30 as illustrated in FIG. 2, in which as each of the dial operation units 51*a* is operated, the locking modules 51*b* lock or unlock the locking plate 71.

Here, each of the locking modules 51*b* comprises a locking member 51*c* for blocking the movement of the locking plate 71 from the locked position to the unlocked position, and when the dial operation units 51*a* are operated, for example, when PIN number is correctly input, the locking modules 51*b* release the locking members 51*c* from the locking plate 71, thereby enabling the movement of the locking plate 71.

Although in the present embodiment, a pair of dial type locking module 51*b* is installed, it is obvious that a single dial type locking module may be provided, or a locking module of another known type, for example, a key type locking module may be provided.

Hereinbelow, a locking unit 80 of the door locking apparatus according to the first embodiment will be described in detail with reference to FIGS. 3 and 4.

The locking unit 80 according to the present embodiment comprises an unlocking restraint module (83, 84). Here, when external force is applied from the outside, the unlocking restraint module (83, 84) is caught in the body frame 10. When the locking unit 80 is relatively moved in relation to the locking plate 71, the unlocking restraint module (83, 84) according to the first embodiment is caught in the locking hole 11. As a result, the locking unit 80 is blocked from being released from the locking hole 11.

Here, the locking unit 80 according to the first embodiment may comprise first fastening plate 81, second fastening plate 82, and a plate fastening unit (81*a*, 82*a*, 85).

When the locking unit 80 is relatively moved in relation to the locking plate 71 by external force, the unlocking restraint module (83, 84) according to the first embodiment is caught in the locking hole 11, thereby blocking the movement of the locking unit 80 in the unlocking direction. That is, when external force is applied to the locking unit 80 from the outside in the unlocking direction (in the direction of releasing the locking unit 80 from the locking hole 11), and the locking unit 80 is forcibly moved in the unlocking direction, the unlocking restraint module (83, 84) is operated and caught in the locking hole 11, thereby blocking the movement of the locking unit 80 in the unlocking direction. Consequently, the locking unit 80 provided on the locking plate 71 is blocked from being released from the locking hole 11.

In another example, when an external force is applied to the unlocking restraint module (83, 84), a part of the unlocking restraint module (83, 84) protrudes in a direction to be caught by the body frame 10, for example, in the locking hole 11, thereby blocking the movement of the locking unit 80 in the unlocking direction. Consequently, the locking unit 80 installed on the locking plate 71 is blocked from being released from the locking hole 11.

As a result, when a thief or a robber targets the gap between the door 30 and the body frame 10 using various tools to apply an external force so as to forcibly move the locking unit 80 in the unlocking direction, or applies a strong external force using, for example, a hammer so as to forcibly move the locking unit 80 in the unlocking direction, the unlocking restraint module (83, 84) is caught in the locking hole 11 to block the movement of the locking unit 80, thereby inhibiting forcible unlocking.

Figure 3:
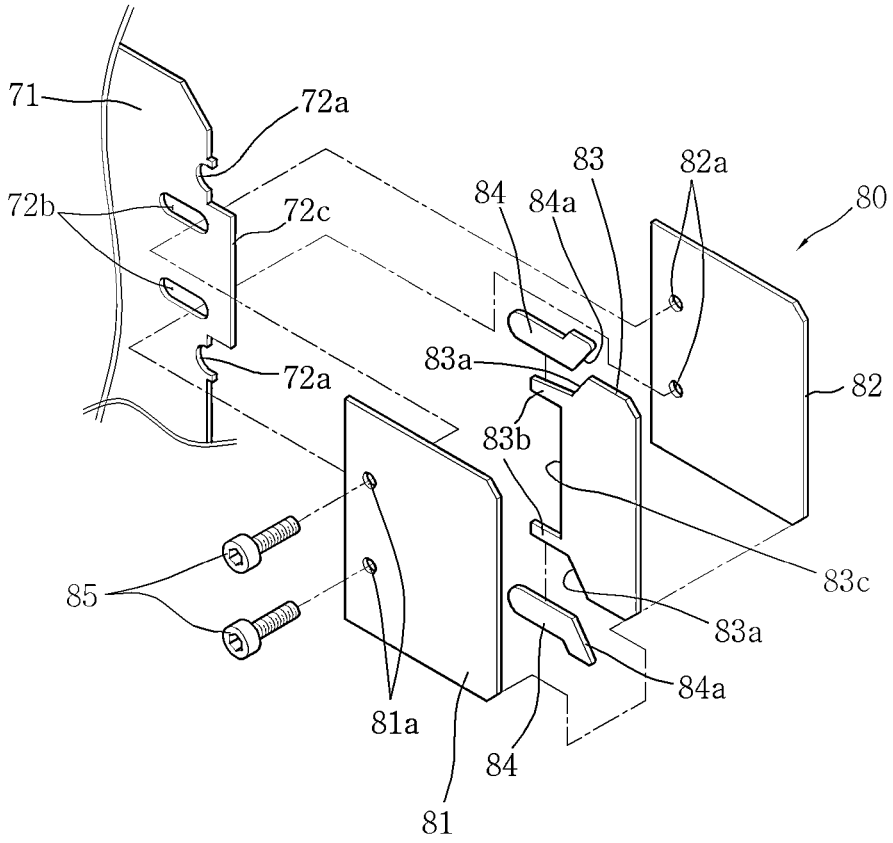
FIG. 3 is an exploded perspective view of the locking unit of the door locking apparatus according to the first embodiment.
Figure 4:
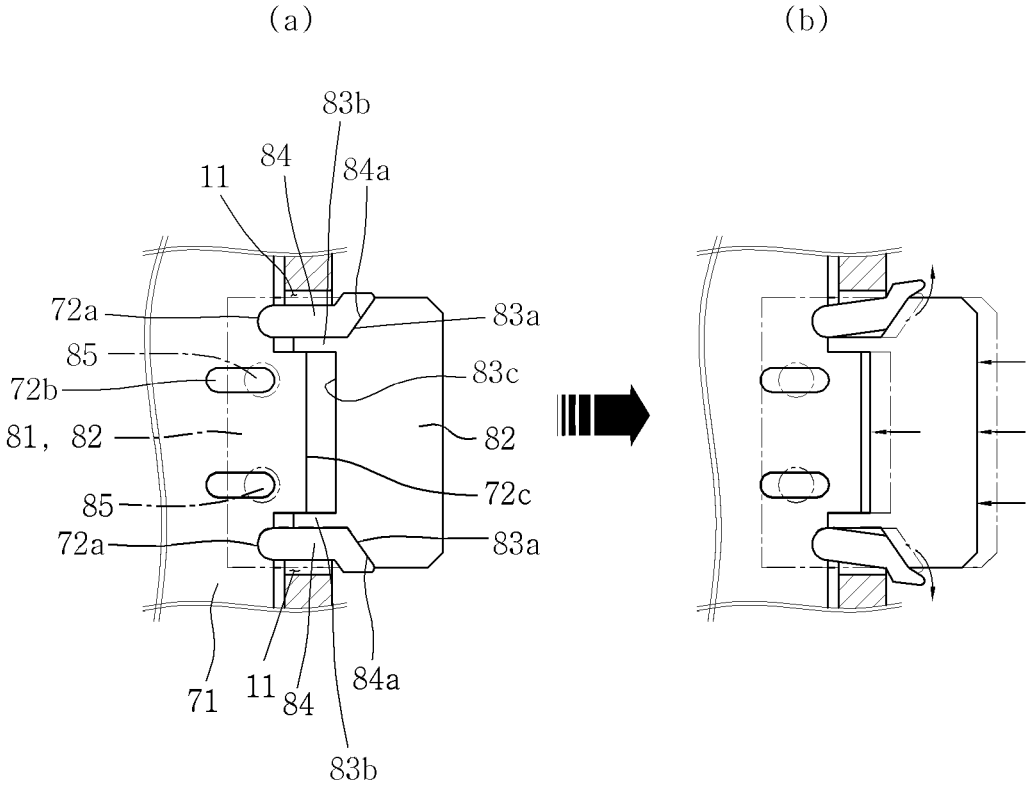
FIG. 4 is a view for describing an operating state of the locking unit of the door locking apparatus according to the first embodiment.

Referring to FIGS. 3 and 4 more specifically, the unlocking restraint module (83, 84) may comprise at least one unlocking restraint member 84 and an operation plate 83.

One side of the unlocking restraint member 84 (in the unlocking direction of the unlocking restraint member 84) is in contact with the locking plate 71 at one end thereof. In addition, the other side of the unlocking restraint member 84 is inserted in the locking hole 11 in the locked position. In the present embodiment, as illustrated in FIGS. 3 and 4, a pair of the unlocking restraint member 84 is installed on the opposite sides of the operation plate 83.

When the locking unit 80 is relatively moved in relation to the locking plate 71 by an external force, that is, when the locking plate 71 is moved in the unlocking direction by an external force in a state where a forcible external force is applied to the locking unit 80 from the outside so that the locking plate 71 is not moved, the operation plate 83 operates the unlocking restraint members 84 in such a manner that the unlocking restraint members 84 are caught in the locking hole 11.

Here, as illustrated in FIG. 4*a*, the operation plate 83 is installed to be spaced apart from the locking plate 71, in which when the locking unit 80 is moved in the unlocking direction by an external force, the operation plate 83 pushes the unlocking restraint members 84 while being moved toward the locking plate 71.

In that event, when an external force is applied, the unlocking restraint members 84 are slid to be rotated and protrude, thereby being caught in the locking hole 11. This will be described below in detail.

In the first embodiment, the first slopes 84*a* and the second slopes 83*a* are formed in the unlocking restraint members 84 and the operation plates 83, respectively, to be opposite to each other such that the unlocking restraint members 84 are moved to a position where the unlocking members 84 are caught in the locking hole 11 when the unlocking restraint members 84 are pushed.

Referring to FIGS. 3 and 4, on the other side of each of the unlocking restraint members 84, i.e. on the edge area of each of the unlocking restraint members 84 in the locking direction, the first slopes 84*a* are formed along the moving direction of the locking plate 71. In addition, the second slopes 83*a* are formed on the operation plate 83 to be opposite to the first slopes 84*a*.

With the above-mentioned construction, when the operation plate 83 is moved in the unlocking direction, the first slopes 84*a* of the unlocking restraint members 84 are pushed along the second slopes 83*a* of the operation plate 83 in the state where the first slopes 84*a* of the unlocking restraint members 84 and the second slopes 83*a* of the operation plate 83 are in contact with each other. As a result, the other sides of the unlocking restraint members 84 are rotated toward the locking hole 11, thereby being caught in the locking hole 11.

The locking plate 71 is formed with rotation guide recesses 72*a* on the locking unit 80 side end, and the one side of each of the unlocking restraint members 84 is inserted into one of the rotation guide recesses 72*a*. The inner radial portions of the rotation guide recesses 72*a* may be rounded, and the one side of each of the unlocking restraint members 84 may also be rounded.

With this construction, when the operation plate 83 pushes the unlocking restraint members 84, the unlocking restraint members 84 are rotated about the axes of the rotation guide recesses, respectively, in the state where the locking plate side ends are inserted into the rotation guide recesses 72*a*. As a result, the other sides of the unlocking restraint members 84 are moved toward to the locking hole 11 to be caught in the locking holes 11.

Referring to FIG. 3 again, the first fastening plate 81 is coupled to the second fastening plate 82 with the unlocking restraint module (83, 84) being interposed therebetween, thereby fixing the unlocking restraint module (83, 84) accommodated therebetween.

In addition, the first fastening plate 81 and the second fastening plate 82 are fastened to the locking plate 71 by the plate fastening unit (81*a*, 82*a*, 85). In the present embodiment, the plate fastening unit (81*a*, 82*a*, 85) is constituted by first bolt fastening holes 81*a*, second bolt fastening holes 82*a* and fastening bolts 85.

The first bolt fastening holes 81*a* are formed through the first fastening plate 81, and the second bolt fastening holes 82*a* are formed through the second fastening plate 82 to correspond to the first bolt fastening holes 81*a* in position.

In addition, the fastening bolts 85 are inserted from one side of the first bolt fastening holes 81*a* and the second bolt fastening hole 82*a* to the other side, thereby fastening the first fastening plate 81 and second the fastening plate 82 with each other.

The locking plate 71 is formed with bolt holes 72*b* to allow the fastening bolts 85 to pass through the bolt holes 72*b* when the fastening bolts 85 pass through the first bolt fastening holes 81*a* and the second bolt fastening holes 82*a*, so that the first fastening plate 81 and the second fastening plate 82 can be fastened to the locking plate 71.

In that event, the bolt holes 72*b* are formed as elongated holes that allow the fastening bolt 85 to be moved in the unlocking direction in order to assure that when the locking unit 80 is moved in the unlocking direction by external force, the first fastening plate 81 and the second fastening plate 82 can be relatively moved in relation to the locking plate 71. That is, as the bolt holes 72*b* allow the passage of the fastening bolts 85 through them and are formed as elongated hole shapes along the moving direction of the locking plate 71, the fastening bolts 85 are enabled to be moved in the unlocking direction.

Here, the unlocking restraint module (83, 84), and the locking plate 71 are maintained in the rigidly fastened condition between the first fastening plate 81 and the second fastening plate 82 by the fastening bolts 85. Normally, that is, in a state when no malicious strong external force is applied, the locking unit 80 is moved together with the locking plate 71 according to the movement of the locking plate 71 in the locking direction and unlocking direction, thereby conducting the locking and unlocking functions of the door 80 in relation to the body frame 10.

That is, the fastening bolts 85 are provided to have a fastening force in a level to be capable of rigidly securing the unlocking restraint module (83, 84) and the locking plate 71 between the first fastening plate 81 and the second fastening plate 82 when the locking unit 80 performs normal locking and unlocking actions, but not to be capable of enduring a malicious strong external force. Accordingly, when the strong external force is applied to the locking unit 80 as described above and overcomes the fastening force by the fastening bolts 85, the locking unit 80 is allowed to be moved in the unlocking direction along the elongated holes in the locking plate 71.

In addition, although not illustrated, a fastening bolt may be employed to fasten the first fastening plate 81, the second fastening plate 82, and the operation plate 83 in the unlocking restraint module (83, 84) in such a manner that these plates can be rigidly coupled to each other.

In connection with this construction, the operating process of the unlocking restraint module (83, 84) when a robber or a thief targets the gap between the door 30 and the body frame 10 using various tools to forcibly move the locking unit 80 in the unlocking direction will be described with reference to FIG. 4.

At first, when forcible external force is applied to the locking unit 80 in the unlocking direction in the state where the locking unit 80 of the door locking apparatus of the door 30 is inserted into the locking hole 11 of the body frame 10 as illustrated in FIG. 4*a*, the locking unit 80 is moved in the unlocking direction as illustrated in FIG. 4*b*.

At this time, the first fastening plate 81, the second fastening plate 82, and the operation plate 83 of the unlocking restraint module (83, 84) which are comprised in the locking unit 80 are moved in the unlocking direction by the external force, the unlocking restraint members 84 are firstly blocked from the movement in the unlocking direction by the locking plate 71 since the ends in the one side of the unlocking restraint members 84 are in contact with the locking plate 71.

As a result, the second slopes 83*a* in the operation plate 83 in the unlocking restraint module (83, 84) are moved in the unlocking direction while pushing the first slopes 84*a* in the unlocking restraint members 84, and the ends in the other side of the unlocking restraint members 84 are moved upward and downward in FIG. 4, respectively, and caught in the locking hole 11 in the body frame 10. Accordingly, the entirety of the locking unit 80 is blocked from being moved in the unlocking direction, and hence the locking unit 80 will maintain the state where the locking unit is caught in the locking hole 11, i.e. the locking state.

Meanwhile, at the locking plate 71 side end of the operation plate 83 according to the present embodiment, guide ribs 83*b* may be provided with a positioning recess 83*c* formed by a pair of guide ribs 83*b* which are spaced away from each other. In addition, the locking plate 71 may be formed with a positioning rib 72*c* protruding toward the operation plate 83.

Accordingly, when the locking unit 80 is assembled to the locking plate 71, the positioning rib 72*c* is inserted into the positioning recess 83*c* along the guide ribs 83*c*, the up and down position of the locking unit 80, i.e., the up and down position in FIG. 3 is determined, which allows easy assembling of the locking unit 80 and the locking plate 71.

A Door Locking Apparatus According to the Second Embodiment

Hereinafter, the door locking apparatus according to the second embodiment will be described in detail with reference to FIGS. 5 to 7. Here, in describing the door locking apparatus according to the second embodiment, the components which are the same as those in the first embodiment as described above may be depicted by the same referential numerals and the descriptions thereof may be omitted. In addition, since the construction of the enclosure 1, to which the door locking apparatus according to the second embodiment is applied, is substantially similar to that illustrated in FIG. 1, the detailed description thereof will be omitted.

Figure 5:
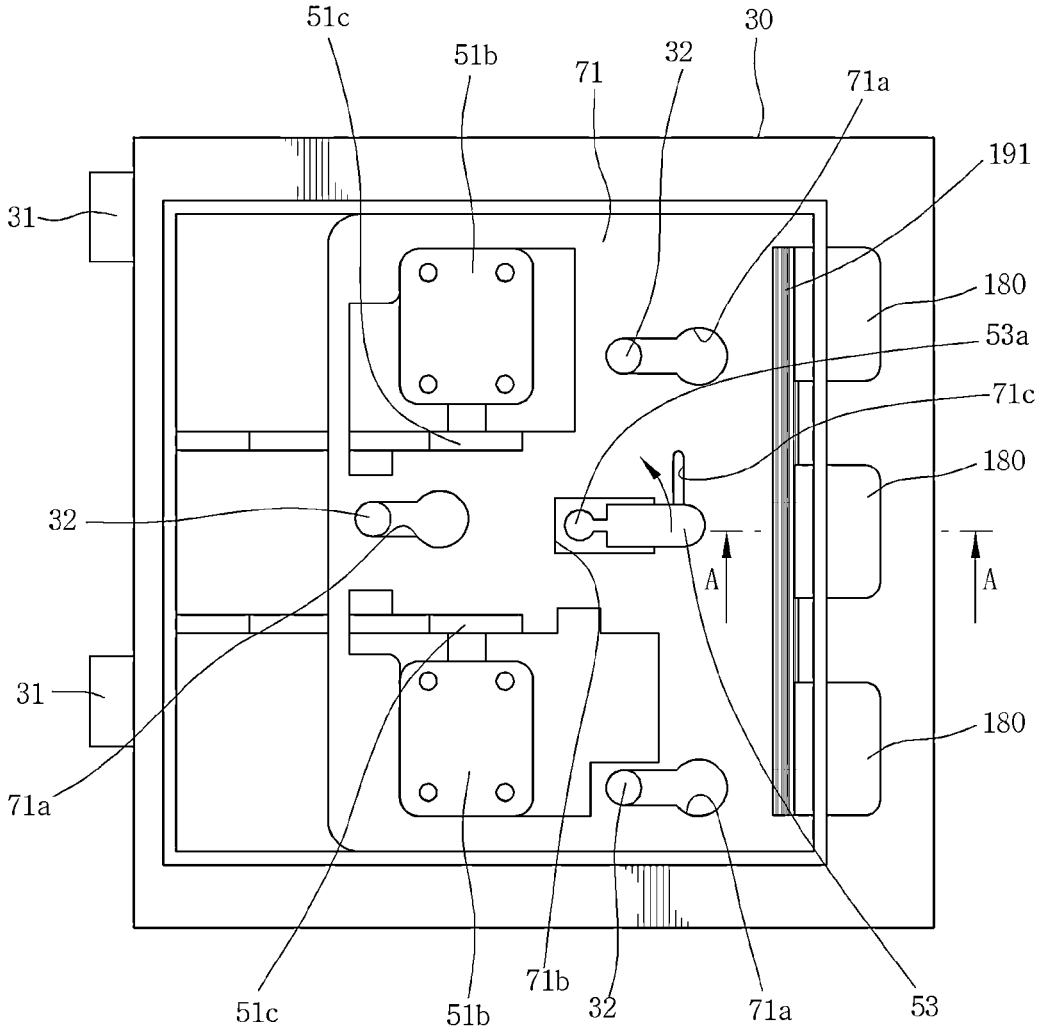
FIG. 5 is a front view illustrating the inner side of a door which is provided with a door locking apparatus according to a second embodiment.

FIG. 5 is a front view illustrating the inner side of a door 30 which is provided with the door locking apparatus according to the second embodiment. The door locking apparatus according to the second embodiment locks and unlocks the door 30 in relation to the body frame 10 in the state where the door 30 closes the body frame 10 as in the first embodiment.

As illustrated in FIG. 5, the door locking apparatus according to the second embodiment comprises an operation unit 52, a locking plate 71, at least one locking unit 180 and an unlocking restraint module (91, 92).

The operation unit 52 is installed on the outer side of the door 30, and operated by the user to reciprocate the locking plate 71 between a locked position and an unlocked position. The locking plate 71 is installed in the inside of the door 30 to be movable between the locked position where the door 30 is locked and the unlocked position where the door 30 is unlock according to the operation of the operation unit 52. Since the constructions and cooperative movements of the operation unit 52 and the locking plate 71 according to the second embodiment are the same as those in the first embodiment, the detailed description thereof will be omitted.

At least one locking unit 180 is installed on the locking plate 71. In the present embodiment, although three locking units 180 are arranged on the locking plate 71 to be spaced apart from each other by a predetermined interval and installed on the locking plate 71 as illustrated in FIG. 5, it is obvious that the technical idea of the second embodiment is not limited to the number. Here, the locking units 180 are inserted into the locking hole 11 formed in the body frame 10 in the locked position of the locking plate 71, thereby causing the door 30 to be locked to body frame 10. In addition, the locking units 180 are released from the locking hole 11 in the unlocked position of the locking plate 71, thereby allowing the door 30 to be opened in relation to the body frame 10.

When at least one locking unit 180 is moved in the unlocking direction by external force, the unlocking restraint module (91, 92) restrains the movement of the locking plate 71 in the unlocking direction. That is, when external force is applied to the locking unit 180 from the outside in the unlocking direction (in the direction of releasing the locking unit 180 from the locking hole 11), and the locking unit 180 is forcibly moved in the unlocking direction, the unlocking restraint module (91, 92) blocks the movement of the locking plate 71 in the unlocking direction, thereby blocking the locking unit 180 provided on the locking plate 71 from being released from the locking hole 11.

As a result, when a thief or a robber targets the gap between the door 30 and the body frame 10 using various tools to apply external force so as to forcibly move the locking unit 180 in the unlocking direction, or applies strong external force using a hammer so as to forcibly move the locking unit 180 in the unlocking direction, the unlocking restraint module (91, 92) blocks the movement of the locking plate 71, thereby inhibiting forcible unlocking.

Herein below, a specific embodiment of the unlocking restraint module (91, 92) according to the second embodiment will be described in detail with reference to FIGS. 6 and 7.

The unlocking restraint module (91, 92) may comprise a first restrain unit 91 installed on the locking plate 71 to be moved together with the locking plate 71, a second restraint unit 92 installed on the door 30 to guide the movement of the first restraint unit 91 according to the movement of the locking plate 71.

In that event, when the locking unit 180 is moved in the unlocking direction by external force, the locking unit 180 restrains the relative movement of the first restraint unit 91 and the second restraint unit 92, thereby restraining the locking plate 71 from moving in the unlocking direction.

Specifically, in normal locking and unlocking actions, the first restraint unit 91 provided on the locking plate 71 is guided by the second restraint unit 92 provided on the door 30, so that the first restraint unit 91 is moved together with the locking plate 71 when the locking plate 71 is moved between the locked position and the unlocked position.

Whereas, when the locking unit 180 is moved in the unlocked position by external force, the locking unit 180 blocked the relative movement between the first restraint unit 91 and the second restraint unit 92, the first restraint unit 191 is restrained by the second restraint unit 92 fixed to the door 30, the movement of the locking plate 71 in the unlocking direction is restrained by the first restraint unit 91, and the locking units 180 cannot be moved in the unlocking direction any more due to the restraint of the locking plate 71. As a result, the locking unit 180 cannot be released from the locking hole 11.

Figure 6:
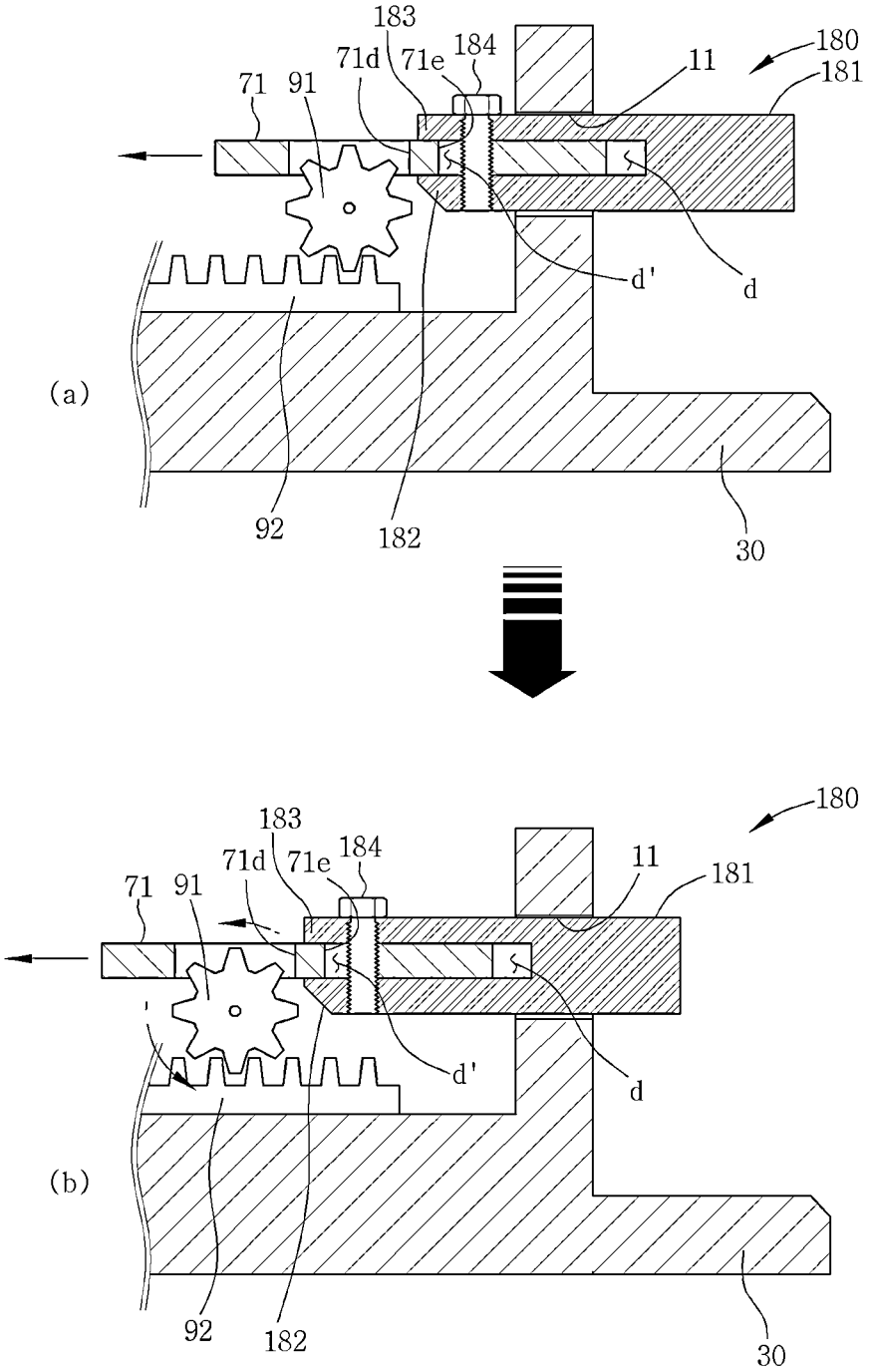
FIG. 6 is a view for describing normal locking and unlocking states of an unlocking restraint module of the door locking apparatus according to the second embodiment.
Figure 7:
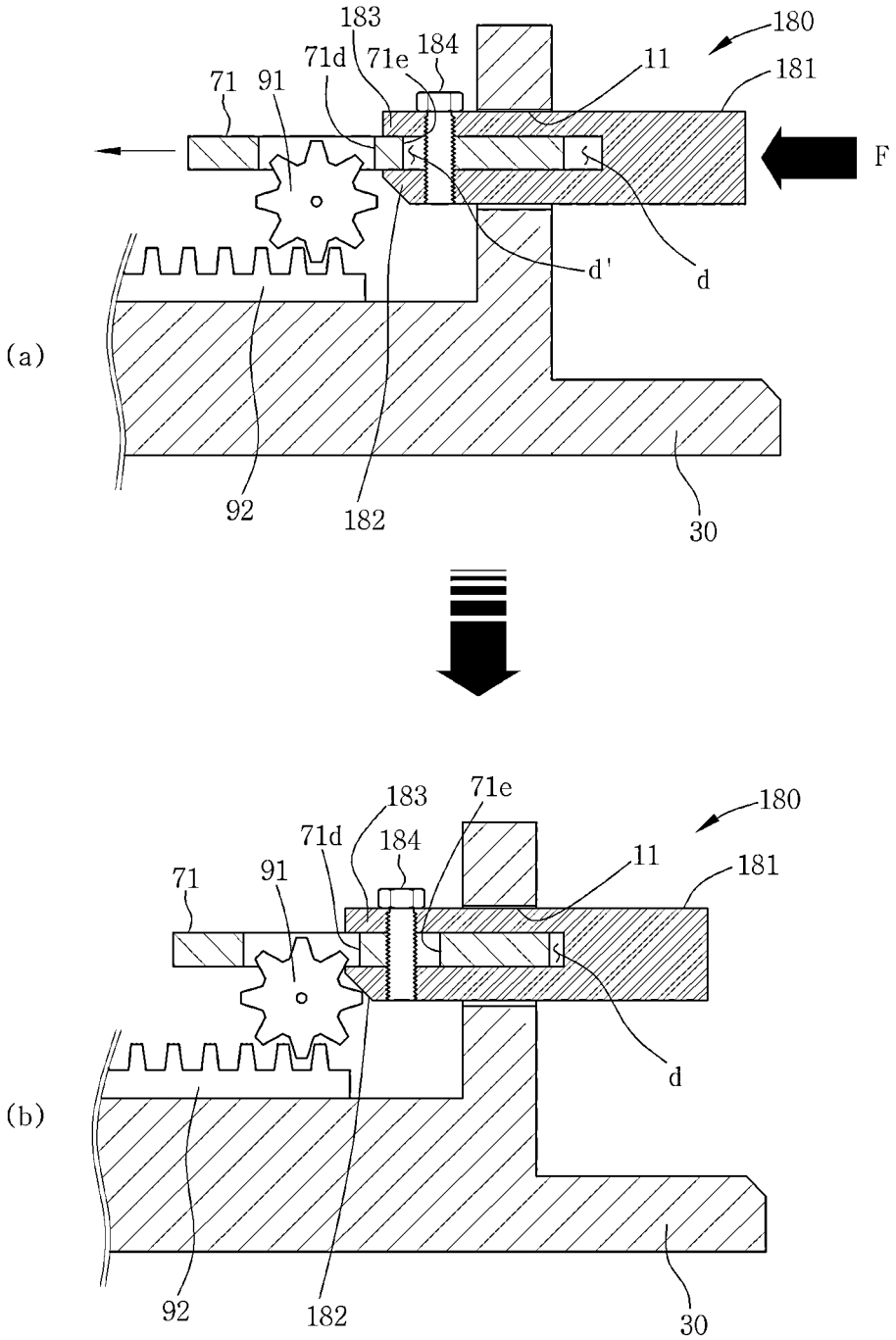
FIG. 7 is a view for describing an operating state of the unlocking restraint module of the door locking apparatus according to the second embodiment when an abnormal external force is applied.

In the present embodiment as illustrated in FIGS. 6 and 7, the second restraint unit 92 is formed as a rack gear installed on the door 30 along the moving direction of the locking plate 71, and the first restraint unit 91 is formed as a pinion gear to be rotated by being engaged with the rack gear, thereby being moved according to the movement of the locking plate 71.

FIG. 6*a* is a cross-sectional view illustrating the normal locking state where the locking unit 180 is inserted into the locking hole 11, and FIG. 6*b* is a cross-sectional view illustrating the state where the locking unit 180 is moved from the locking hole 11 in the unlocking direction according to a normal unlocking action.

As illustrated in FIGS. 6*a* and 6*b*, when the user moves the locking plate 71 from the locked position to unlocked position by operating the operation unit 52, the pinion gear installed on the locking plate is engaged with the rack gear installed on the door 30 and rotated, thereby being moved together with the locking plate 71 as illustrated in FIG. 6*b*. Consequently, the locking unit 180 installed in the locking plate 71 is released from the locking hole 11.

FIG. 7*a* is a cross-sectional view illustrating the normal locking state where the locking unit 180 is inserted into the locking hole 11 as in FIG. 6*a*, and FIG. 7*b* illustrates the operating condition of the unlocking restraint module (91, 92) when external force is applied to the locking unit 180 in the unlocking direction from the outside.

As illustrated in FIG. 7*b*, when external force is applied to the locking unit 180 from the outside, the locking unit 180 is moved in the unlocking direction by the corresponding external force, in which case, because the locking plate 71 is in the locked state by the locking unit 180, the movement of the locking unit 180 is relatively made in relation to the pinion gear installed in the locking plate 71 as well as the locking plate 71.

As the locking unit 180 is moved by the external force, a part of the locking unit 180 is got stuck between a pair of teeth of pinion gear as illustrated in FIG. 7*b*, thereby restraining rotation of the pinion gear and blocking the movement of the locking plate 71 in the unlocking direction. As a result, even if external force is additionally applied to the locking unit 180, the locking unit 180 cannot be moved in the unlocking direction any more.

In the present embodiment as illustrated in FIGS. 6 and 7, the locking unit 180 comprises a locking body 181 inserted into or released from the locking hole 11, and first and second fastening portions 182 and 183 protruding in the unlocking direction from the locking body 181. Here, the first and second fastening portions 182 and 183 are formed to be spaced apart from each other and to extend from the locking body 181, and as an end of the locking plate 71 is interposed between the first and second fastening portions 182 and 183. Accordingly, the locking unit 180 and the locking plate 71 are coupled to each other.

In addition, when the locking unit 180 is moved in the unlocking direction by external force directed in the unlocking direction, at least one of the first fastening portion 182 and the second fastening portion 183 is got stuck between the teeth of the pinion gear, thereby restraining the rotation of the pinion gear. Although in FIG. 7*b* the first fastening portion 182 is got stuck between the teeth of the pinion gear, it is obvious that the second fastening portion 183 may be got stuck or the first fastening portion 182 and second fastening portion 183 may be selectively or simultaneously got stuck between the teeth of the pinion gear.

In the second embodiment as illustrated in FIG. 6, when the locking unit 180 is moved in the unlocking direction by the external force directed in the unlocking direction, the end of the locking plate 71 is got stuck between the first fastening portion 182 and the second fastening portion 183 in the state where they are spaced apart from the locking body 181.

That is, in the normal engagement state of the locking unit 180 and locking plate 71, a space d is formed between the locking body 181 and the locking plate 71, and due to the space d, the movement of the locking plate 71 by the external force may be independently caused in relation to the locking plate 71.

In addition, in the second embodiment, the first fastening portion 182 and the second fastening portion 183 are formed with a first bolt fastening hole and a second bolt fastening hole at opposite locations, respectively, the locking plate 71 is formed with a bolt hole 71*e* such that the fastening bolt 184, which passes through first bolt fastening hole, can be fastened to the second bolt fastening hole through the bolt hole 71*e*, thereby allowing the locking unit 180 and locking plate 71 to be coupled with each other by fastening the bolt.

As illustrated in FIGS. 6*a* and 6*b*, the bolt hole 71*e* formed through the locking plate 71 is formed with a shift space d' such that the fastening bolt 184 can be moved in the unlocking direction when the locking unit 180 is moved in the unlocking direction by the external force directed to the unlocking direction. Accordingly, when external force is applied to the locking unit 180 such that the locking unit 180 is moved independently from the locking plate 71, the fastening bolt 184 is also moved together with the locking unit 180 through the shift space d' independently from locking plate 71.

Here, the locking plate 71 and the locking unit 180 are coupled to each other though the fastening bolt 184 in such a manner that when the locking plate 71 and the locking unit 180 are moved in the normal locking direction and unlocking direction, the fastening bolt 184 is moved to the shift space d' or only the locking unit 180 is moved in the unlocking direction due to the space d. That is, the locking plate 71 and the locking unit 180 are coupled to each other in such a manner that when the locking plate 71 and the locking unit 180 are normally operated, the locking plate 71 and the locking unit 180 can be moved in unison.

As a result, only when an external force exceeding a predetermined level, for example a forcible and strong external force using a hammer, is applied, the locking unit 180 is allowed to be moved in the unlocking direction independently from the locking plate 71.

Meanwhile, in the second embodiment, a gear rotation hole 71*d* is formed through the locking plate 71 in order to ensure the rotation of the pinion gear. Accordingly, as illustrated in FIGS. 6 and 7, the rotation axle of the pinion gear may be provided closer to the surface of the locking plate 71. As a result, the affection to the entire thickness of the door locking apparatus by the construction of the unlocking restraint unit may be minimized.

In addition, although in the second embodiment, the unlocking restraint unit is formed over three locking units 180 as illustrated in FIG. 5 such that the unlocking restraint unit acts on all the three locking units 180, the unlocking restraint unit is not limited to this and may act on at least one locking unit 180.

A Door Locking Apparatus According to the Third Embodiment

Hereinafter, the door locking apparatus according to the third embodiment will be described in detail with reference to FIGS. 8 to 12. Here, in describing the door locking apparatus according to the third embodiment, the components which are the same as those in the first embodiment as described above may be depicted by the same referential numerals and the descriptions thereof may be omitted.

Figure 8:
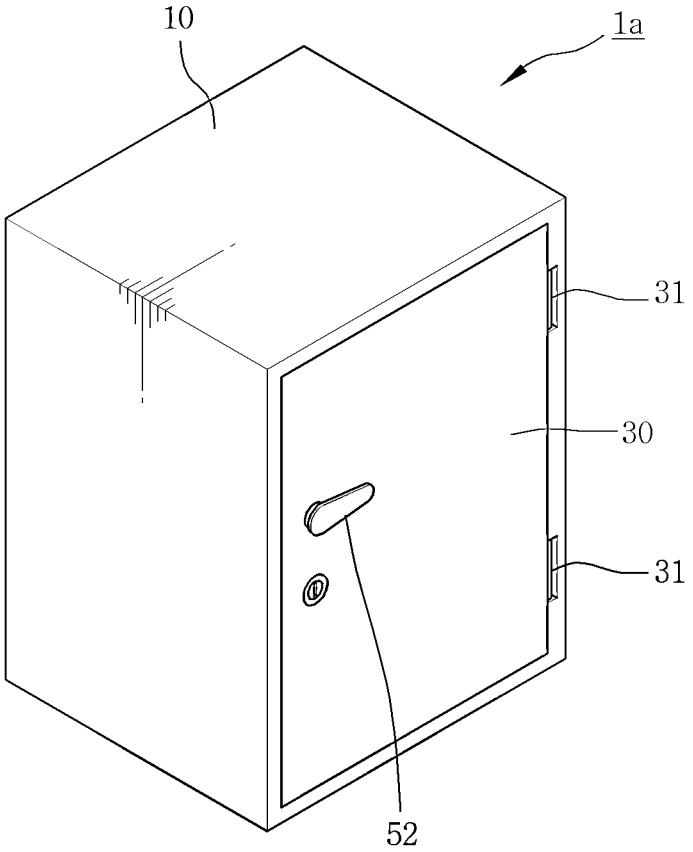
FIG. 8 is a perspective view of an enclosure according to another embodiment.
Figure 9:
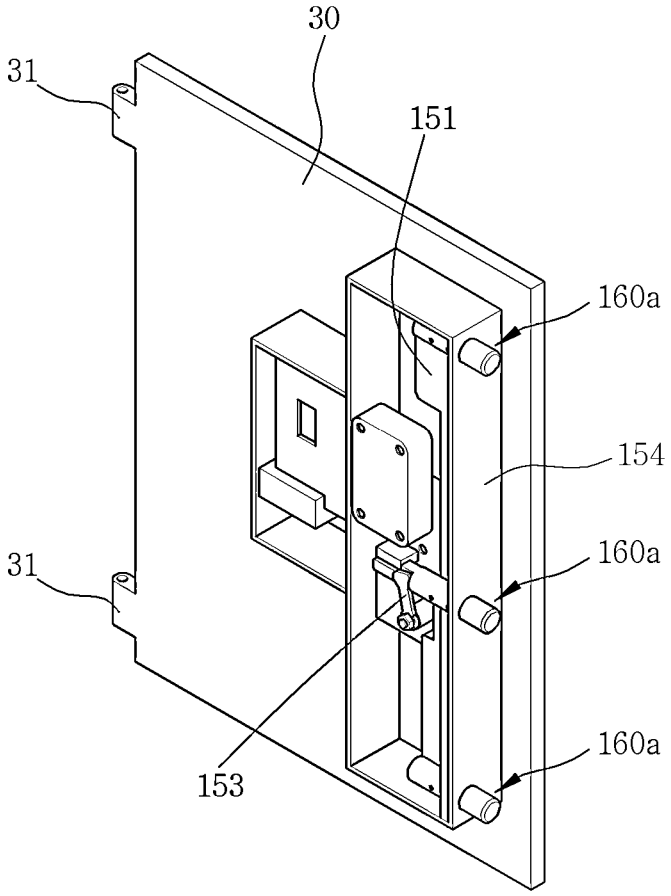
FIG. 9 is a perspective view of a door which is provided with a door locking apparatus according to a third embodiment.
Figure 10:
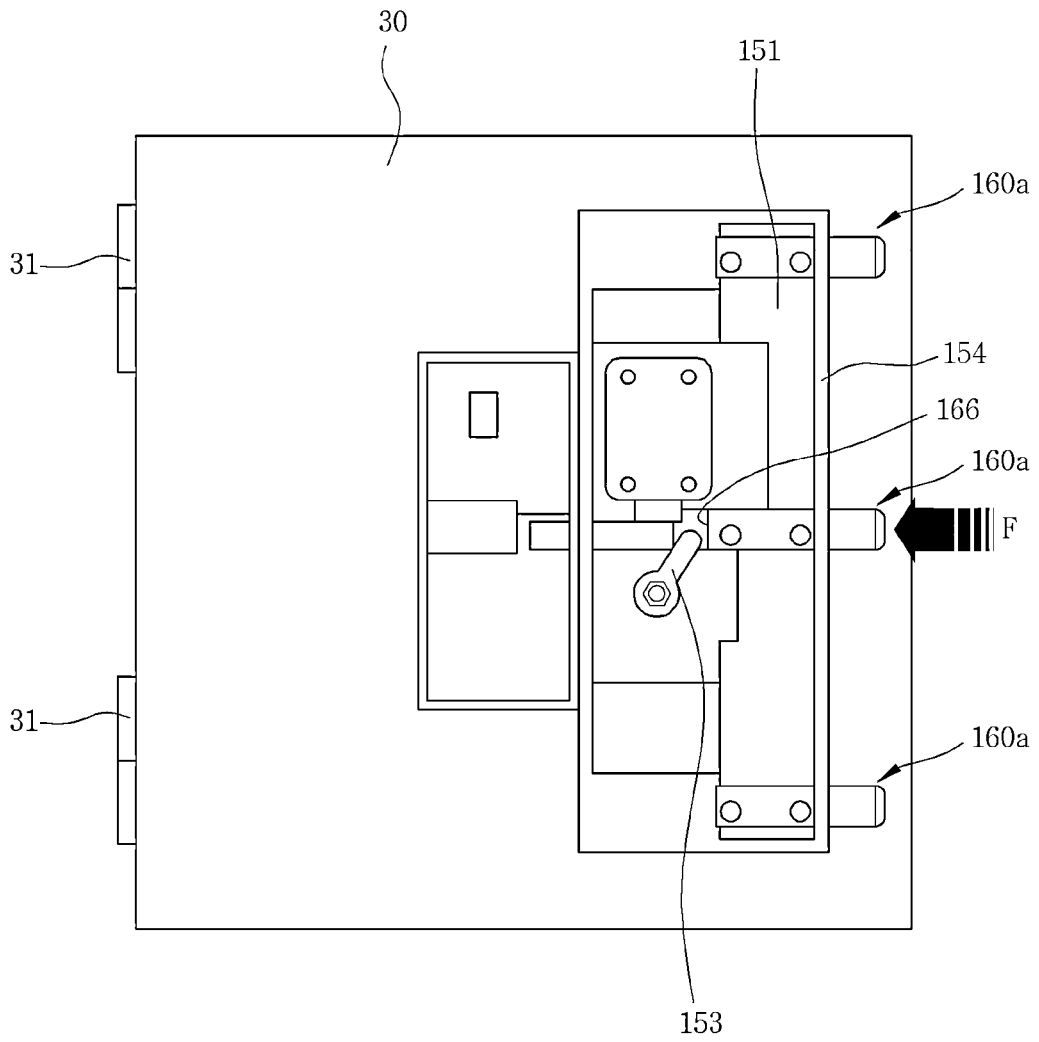
FIG. 10 is a front view of the door which is provided with the door locking apparatus according to the third embodiment.

FIG. 8 is a perspective view of an enclosure 1*a* according to another embodiment, FIG. 9 is a perspective view of a door 30, in which a door locking apparatus according to the third embodiment, and FIG. 10 is a front view of the door 30, in which the door locking apparatus according to the third embodiment.

Although the embodiment as illustrated in FIG. 8, the enclosure 1*a* is provided in the form of a safe, it is obvious that the technical idea of the third embodiment may also comprise another type of an enclosure 1*a* that is formed with an accommodation space in the inside thereof, and is opened/closed by the door 30 which is locked or unlocked by the door locking apparatus according to the present embodiment. The another type of the enclosure may comprise an automatic medium processing system, such as an automatic cache dispenser, for example, an automatic teller's machine (ATM), and an automatic financial transaction terminal.

Referring to FIGS. 8 to 10, the enclosure 1*a* according to the present embodiment comprises a body frame 10 having an accommodation space (not illustrated in the inside there, a door 30 rotatably coupled to the body frame 10 to open/close the accommodation space of the body frame 10, and a door locking apparatus locking and unlocking the door 30 in relation to the body frame 10. For example, the door 30 may be joined to the body frame 10 by a hinge structure, such as hinges 31 as illustrated in FIG. 9, such that the door 30 is rotatably coupled to the body frame 10.

The door locking apparatus is installed in the door 30 and locks or unlocks the door 30 in relation to the body frame 10 in the state where the door 30 closes the body frame 10. Here, the door locking apparatus according to the third embodiment comprises one or more locking units 160*a*, and an operation unit 52.

Figure 11:
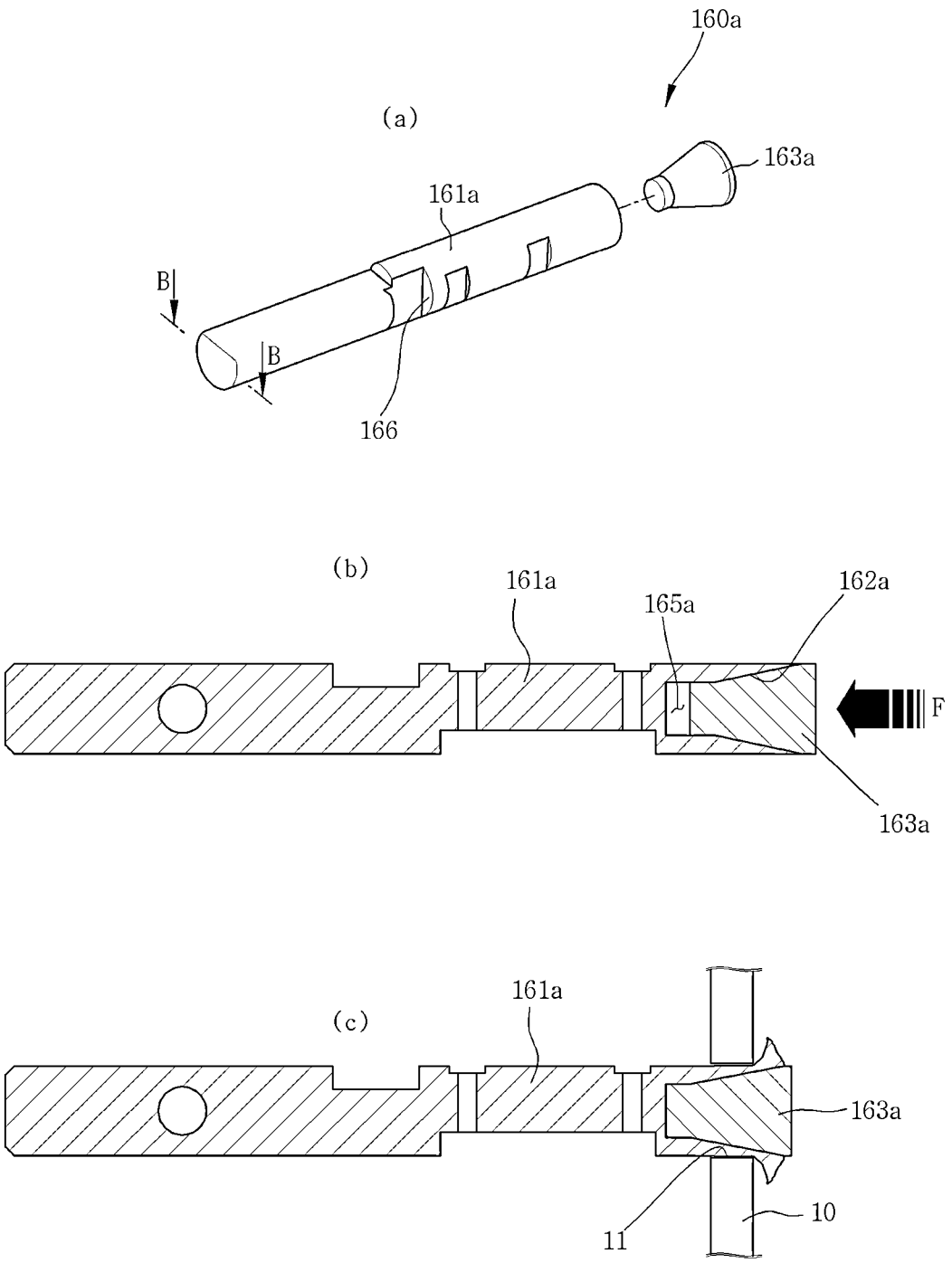
FIG. 11 is a view illustrating an example of the locking unit of the door locking apparatus according to the third embodiment.
Figure 12:
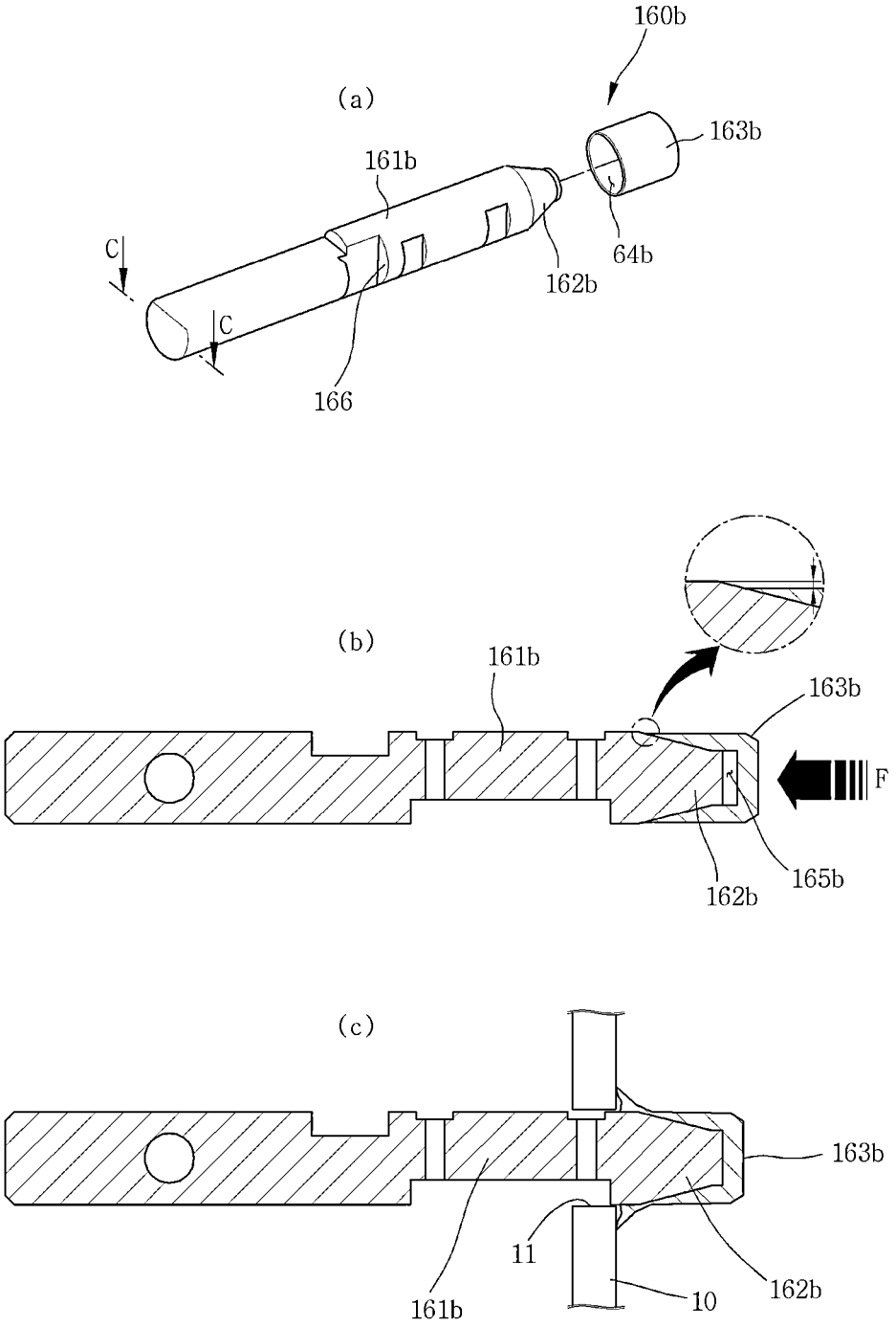
FIG. 12 is a view illustrating another example of the locking unit of the door locking apparatus according to the third embodiment.

As illustrated in FIGS. 9 and 10, the locking units 160*a* are installed on the inner side of the door 30 to be capable of being inserted into a locking hole 11 formed in the body frame 10 (see FIGS. 11 and 12). When the locking units 160*a* are inserted into the locking hole 11, the door 30 is in the locking state where the door is locked in relation to lock the body frame 10, and when the locking unit 160*a* is released from the locking hole 11, the door 30 is in the unlocking state where the door 30 is unlocked in relation to the body frame 10.

The operation unit 52 is installed on the outer side of the door 30 and operated to cause the locking units 160*a* to be inserted into or released from the locking hole 11. The present embodiment as illustrated in FIG. 8, the operation unit 52 is provided as a door handle type to be grasped by a user to be rotated forward and rearward. Accordingly, when the user rotates the operation unit 52 in one direction, the locking units 160*a* are inserted into the locking hole 11, and when the user rotates the operation unit in the other direction, the locking units 160*a* are released from the locking hole 11, thereby allowing the door 30 to be locked or unlocked in relation to the body frame 10.

Here, a construction for converting the forward and rearward rotation movements of the operation unit 52 into the reciprocation movements of the locking units 160*a* in the inserting direction and releasing direction may be applied in various forms. For example, the operation unit 52 installed on the outer side of the door 30 is connected with an operation lever 153 illustrated in FIGS. 9 and 10 through a rotation axle extending through the door 30 such that the forward and rearward rotation movements of operation unit 52 may be transmitted as the forward and rearward rotation movements of the operation lever 153.

In addition, one side of the operation lever 153 is inserted into a groove 166 formed in the locking unit 160*a* such that the forward and rearward rotation movements of the operation lever 153 can be transmitted as the reciprocation movements of the locking unit 160*a*. The present embodiment as illustrated in FIGS. 9 and 10, three locking units 160*a* are provided, and the locking unit 160*a* interposed between a pair of the locking units 160*a* is formed with the groove 166.

In addition, the locking unit 160*a* formed with the groove 166 and the remaining pair of the locking units 160*a* are fixed to the locking plate 151 such that the reciprocation movements of the locking unit 160*a* formed with the groove 166 are transmitted to the remaining pair of the locking units 160*a* through the locking plate 151. In this manner, the forward and rearward rotation movements of the operation unit 52 can be converted into the reciprocation movements of the three locking units 160*a*.

As illustrated in FIGS. 9 and 10, the locking units 160*a* and the locking plate 151 are installed on the inner side of the door 30 in such a manner that the reciprocation movements thereof are stably guided by the guide plate 154 installed on the inner side of the door 30.

With this arrangement, the operation of the operation unit 52, for example, the forward and rearward rotation movements are converted into the reciprocation movements in the directions of inserting and releasing the plurality of locking units 160*a*. It is obvious that the connection construction between the operation unit 52 and the plurality of locking units 160*a* is merely an example for describing the operation of the inventive door locking apparatus, the technical idea of the present embodiment is not limited to this, and various connection constructions well-known in the art may be applied.

Meanwhile, the locking units 160*a* comprise an unlocking restraint module that is operated by external force and caught by the body frame 10 as in the first embodiment. In the third embodiment, when external force is applied to the unlocking restraint module, the unlocking restraint module is deformable in a radially outward direction.

Referring to FIG. 10, when external force is applied to a locking unit 160*a* in the direction F, the outer diameter of a unlocking restraint module locking unit provided at an peripheral area of the locking unit 160*a* is at least partly increased, and due to the increase of the outer diameter of the unlocking restraint module provided at the peripheral area of the locking unit 160*a* inserted into the locking hole 11 to lock the door 30, the unlocking restraint module strongly comes into close contact with the inner wall of the locking hole 11, or is caught in the inner wall of the locking hole 11 (see FIGS. 11*c* and 12*c*), thereby blocking the movement of the locking unit 160*a* in the releasing direction.

In addition, the locking unit 160*a* may deformable in a radially outward direction when an external force exceeding a predetermined level is applied to the locking unit 160*a* in the releasing direction. Accordingly, as the locking unit 160*a* is deformed by an external force produced by the operation of the operation unit 52 for a normal unlocking operation, the normal locking and unlocking operations can be more securely assured.

With this construction, when a thief or robber targets the gap between the door 30 and the body frame 10 using various tools or applies a strong external force using, for example, a hammer to the locking unit 160*a* to forcibly move the locking unit 160*a* in the releasing direction, the peripheral area of the locking unit 160*a* is deformed in a radially outward direction to be more strongly and closely contacted with or caught in the locking hole 11, thereby blocking the attempt to forcibly unlock the door 30.

Herein below, specific embodiments of the inventive locking unit 160*a* will be described in detail with reference to FIGS. 11 and 12.

FIG. 11*a* is an exploded perspective view of the locking unit 160*a*, FIGS. 11*b* and 11*c* are cross-sectional views taken along line B-B in FIG. 11*a* to describe the operation of the locking unit 160*a*. As illustrated in FIG. 11, the locking unit 160*a* according to the third embodiment may comprise a locking body 161*a*. In addition, the unlocking restraint module may comprise a coupling hole 162*a* and a pushing member 163*a*.

Referring to FIG. 11, the locking body 161*a* is inserted into or released from the locking hole 11 according to the operation of the operation unit 52. The construction for making the locking body 161*a* reciprocate in the insertion and releasing directions according to the operation of the operation unit 52 is the same as the embodiments as described above. In FIG. 11, a groove 166 is formed on the locking unit 160*a*, the description will be made as to the locking body 161*a* formed with the groove 166.

In addition, the peripheral portion of the locking body 161*a* in the locking hole 11 side, i.e. the peripheral portion to be inserted into the locking hole 11 is formed with a coupling hole 162*a* to be extend in the releasing direction. In addition, the pushing member 163*a* is inserted into the coupling hole 162*a* in the releasing direction, thereby being coupled to the locking body 161*a*.

In the present embodiment, at least one of the inner diameter portion of the coupling hole 162*a* and the outer diameter portion of the pushing member 163*a* may be formed with a slope. In FIG. 11, both of the inner diameter portion of the coupling hole 162*a* and the outer diameter portion of the pushing member 163*a* are formed with slopes to be opposite to each other.

With this construction, when an external force directed in the releasing direction (in the direction F) as illustrated in FIG. 11*b* while the pushing member 163*a* is being maintained in the state where the pushing member 163*a* is inserted into the coupling hole 162*a*, the pushing member 163*a* is moved in the releasing direction along the inner slope of the coupling hole 162*a*. Due to the slopes formed on the outer diameter portion of the pushing member 163*a* and the slope formed on the inner diameter portion of the coupling hole 162*a*, the pushing member 163*a* pushes the inner diameter portion of the coupling hole 162*a* in a radially outward direction to deform the outer diameter portion of coupling hole 162*a* in a radially outward direction such that the outer diameter portion of the coupling hole 162*a* is caught in the locking hole 11 of the body frame as illustrated in FIG. 11*c*, thereby blocking the entirety of the locking unit 160*a* from releasing and breaking out from the locking hole 11.

In the present embodiment, that the pushing member 163*a* is coupled to the coupling hole 162*a* in such a manner that a space 165*a* is formed between the end of the pushing member 163*a* and the inner end wall of the coupling hole 162*a* as illustrated in FIG. 11*b*, so that the pushing member 163*a* can be moved inwardly in the coupling hole 162*a* by the external force directed in the releasing direction. Through this, when an external force is applied to the pushing member 163*a* in the releasing direction, the pushing member 163*a* pushes the inner wall of the coupling hole 162*a* while being moved by a predetermined distance independently from the coupling hole 162*a*.

Meanwhile, FIG. 12 illustrates another example of the locking unit 160*b* according to the third embodiment. Specifically, FIG. 12*a* is an exploded perspective view of the locking unit 160*b*, FIG. 12*b* and FIG. 12*c* are cross-sectional view taken along line A-A in FIG. 12*a* to describe the operation of the locking unit 160*b*. As illustrated in FIG. 12, the locking unit 160*b* comprises a locking body, and the unlocking restraint module comprises a coupling portion 162*b* and a deformable member 163*b*.

Referring to FIG. 12, the locking body 161*b* is inserted into or released from the locking hole 11 according to the operation of the operation unit 52. The construction for reciprocating the locking body 161*b* in the insertion direction and releasing direction according to the operation of the operation unit 52 is the same as the above-described example. In FIG. 12, a groove 166 is formed on the locking unit 160*b*, and a description will be made as to the locking body 161*b* formed with the groove 166.

In addition, in the locking hole 11 side peripheral area of the locking body 161*b*, i.e. in the peripheral area to be inserted into the locking hole 11, a coupling portion 162*b* is formed. Furthermore, the deformable member 163*b* is formed in a cylindrical shape with an opened end, and the coupling portion 162*b* is inserted into the deformable member 163*b* in the insertion direction.

In the present embodiment, at least one of the outer diameter portion of the coupling portion 162*b* and the inner diameter portion of the deformable member 163*b* may be at least partially formed with a slope. As shown in FIG. 12, the outer diameter portion of the coupling portion 162*b* and the inner diameter portion of the deformable member 163*b* are formed with slopes to be opposite to each other.

With this construction, when an external force directed in the releasing direction (in the direction F) as illustrated in FIG. 12*b* while the coupling portion 162*b* and the deformable member 163*b* are being maintained in the coupled state, the deformable member 163*b* is moved in the releasing direction along the slope in the inside thereof. Due to the slopes formed on the inner diameter portion of the deformable member 163*b* and the slope formed on the outer diameter portion of the coupling portion 162*b*, the deformable member 163*b* is deformed in a radially outward direction such that the deformable member 163*b* is caught by the locking hole 11 of the body frame 10 as illustrated in FIG. 12*c*, thereby blocking the entirety of the locking unit 160*b* from releasing and breaking out from the locking hole 11.

In the present embodiment, the deformable member 163*b* is coupled to the coupling portion 162*b* in such a manner that a space 165*b* is formed between the end of the coupling portion 162*b* and the inner end wall of the deformable member 163*b* as illustrated in FIG. 12*b*, so that the deformable member 163*b* can be moved toward the coupling portion 162*b* side by the external force directed in the releasing direction. Through this, when an external force is applied to the deformable member 163*b* in the releasing direction, the deformable member 163*b* can be deformed while being moved by a predetermined distance independently from the coupling portion 162*b*.

In addition, in the present embodiment as illustrated in an enlarged scale in FIG. 12*b*, the inner diameter of the deformable member 163*b* is smaller than the outer diameter of the locking body 161*b*. Accordingly, when the locking unit 160*b* is inserted into or released from the locking hole 11 for a normal locking or unlocking operation, the deformable member 163*b* is caught by the locking hole 11 and is inhibited from breaking out from the locking body 161*b*.

Even if it was described above that all of the components of an embodiment are coupled as a single unit or coupled to be operated as a single unit, the present embodiment is not necessarily limited. That is, among the components, one or more components may be selectively coupled to be operated as one or more units. In addition, since terms, such as "including," "comprising," and "having" mean that one or more corresponding components may exist unless they are specifically described to the contrary, it shall be construed that one or more other components can be comprised. All of the terminologies containing one or more technical or scientific terminologies have the same meanings that persons skilled in the art understand ordinarily unless they are not defined otherwise. A term ordinarily used like that defined by a dictionary shall be construed that it has a meaning equal to that in the context of a related description, and shall not be construed in an ideal or excessively formal meaning unless it is clearly defined in the present specification.

Although a preferred embodiment has been described for illustrative purposes, those skilled in the art will appreciate that various modifications, additions and substitutions are possible, without departing from the scope and spirit of the embodiment as disclosed in the accompanying claims. Therefore, the embodiments are intended to illustrate the scope of the technical idea as an example, and the scope of the technical idea is not limited by the embodiments. The scope of the technical idea shall be construed on the basis of the accompanying claims in such a manner that all of the technical ideas comprised within the scope equivalent to the claims.

What is claimed is:

1. A door locking apparatus comprising:

an operation unit installed on a door for opening/closing a body frame; and at least one locking unit for locking or unlocking the door installed in the door to be capable of being inserted into or released from a locking hole formed in the body frame according to an operation of the operation unit, wherein the at least one locking unit comprises an unlocking restraint module protruded in accordance with a movement of the at least one locking unit by an external force, and a locking plate provided with the at least one locking unit and moved according to the operation of the operation unit between a locked position where the at least one locking unit is inserted into the locking hole, and an unlocked position where the at least one locking unit is released from the locking hole, and wherein the at least one locking unit is movably coupled to the locking plate to move in relation to the locking plate when the external force is applied.

2. The door locking apparatus as claimed in claim 1, wherein the unlocking restraint module comprises:

at least one unlocking restraint member contacted with the locking plate and inserted into the locking hole in the locked position; and an operation plate for operating the unlocking restraint member in such a manner that when the at least one locking unit is moved in relation to the locking plate by the external force, the unlocking restraint member is protruded.

3. The door locking apparatus as claimed in claim 1, wherein the unlocking restraint member is rotated and protruded when being slid by the external force, thereby restraining the movement of the at least one locking unit in an unlocking direction in relation to the body frame.

4. The door locking apparatus as claimed in claim 2, wherein the operation plate is installed to be apart from the locking plate, and the operation plate is moved toward the locking plate and pushes the unlocking restraint member when the at least one locking unit is moved in an unlocking direction.

5. The door locking apparatus as claimed in claim 4, wherein the unlocking restraint member is formed with a first slope along a moving direction of the locking plate on one side of the unlocking restraint member, wherein the operation plate is formed with a second slope to be opposite to the first slope, and wherein when the operation plate is moved in the unlocking direction, the first slope of the unlocking restraint member is pushed along the second slope of the operation plate such that the unlocking restraint member is protruded.

6. The door locking apparatus as claimed in claim 4, wherein the locking plate is formed with a rotation guide recess at the at least one locking unit, and wherein when the operation plate pushes the unlocking restraint member, the unlocking restraint member is rotated using the rotation guide recess as an axis in a state where the one side of the unlocking restraint member is inserted into the rotation guide recess such that the other side of the unlocking restraint member is protruded.

7. The door locking apparatus as claimed in claim 3, wherein the at least one locking unit further comprises:

a first fastening plate;

a second fastening plate coupled to the first fastening plate with the unlocking restraint module being interposed therebetween; and a plate fastening unit for fastening the first fastening plate and the second fastening plate to the locking plate.

8. The door locking apparatus as claimed in claim 7, wherein the plate fastening unit comprises:

at least one first bolt fastening hole and at least one second bolt fastening hole formed on the first fastening plate and the second fastening plate, respectively, the at least one first bolt fastening hole and the at least one second bolt fastening hole facing each other; and a fastening bolt inserted from one of the first bolt fastening hole and the second bolt fastening hole to the other of the first bolt fastening hole and the second bolt fastening hole, and wherein the locking plate is formed with a bolt hole allowing the fastening bolt to pass through the bolt hole when the fastening bolt is inserted from one of the first bolt fastening hole and the second bolt fastening hole to the other of the first bolt fastening hole and the second bolt fastening hole.

9. The door locking apparatus as claimed in claim 8, wherein the bolt hole is formed as an elongated hole, and when the at least one locking unit is moved in an unlocking direction, the fastening bolt is moved in the unlocking direction in the elongated hole to allow the first fastening plate and the second fastening plate to be relatively moved in relation to the locking plate.

10. The door locking apparatus as claimed in claim 1, wherein the unlocking restraint module is protruded at least partially to restrain the movement of the at least one locking unit in relation to the body frame when the external force is applied.

11. A door locking apparatus comprising:

an operation unit installed on a door for opening/closing a body frame;

a locking plate installed in the door to be movable according to an operation of the operation unit between a locked position where the door is locked and an unlocked position where the door is unlocked;

at least one locking unit installed on the locking plate, and inserted into a locking hole formed in the locking plate in a locked position of the locking plate and released from the locking hole in an unlocked position of the locking plate; and an unlocking restrain module restraining a movement of the at least one locking unit in an unlocking direction when an external force is applied;

wherein the at least one locking unit is movably coupled to the locking plate to move in relation to the locking plate when the external force is applied.

12. The door locking apparatus as claimed in claim 11, wherein the unlocking restraint module comprises a first restraint unit installed on the locking plate to be moved together with the locking plate following the movement of the locking plate, and a second restraint unit installed in the door to guide the movement of the first restraint unit following the movement of the locking plate, and wherein the at least one locking unit restrains a relative movement between the first restraint unit and the second restraint unit when the at least one locking unit is moved in the unlocking direction by the external force in the unlocking direction, thereby restraining the movement of the locking plate in the unlocking direction.

13. The door locking apparatus as claimed in claim 12, wherein the second restraint unit comprises a rack gear installed along a moving direction of the locking plate, and the first restraint unit comprises a pinion gear rotated by being engaged with the rack gear, and moved according to the movement of the locking plate, and wherein when the at least one locking unit is moved in the unlocking direction by the external force in the unlocking direction, a part of the at least one locking unit is inserted between teeth of the pinion gear to restrain a rotation of the pinion gear, thereby restraining the movement of the locking plate in the unlocking direction.

14. The door locking apparatus as claimed in claim 13, wherein the locking plate is formed with a gear rotation hole through the locking plate to ensure the rotation of the pinion gear.

15. The door locking apparatus as claimed in claim 13, wherein the at least one locking unit comprises:

a locking body being inserted into or released from the locking hole; and a first fastening portion and a second fastening portion extending in the unlocking direction from the locking body, and being spaced apart from each other such that an end of the locking plate is inserted therebetween, wherein when the at least one locking unit is moved in the unlocking direction by the external force in the unlocking direction, at least one of the first fastening portion and the second fastening portion is inserted between the teeth of the pinion gear.

16. The door locking apparatus as claimed in claim 15, wherein the end of the locking plate is inserted and coupled between the first fastening portion and the second fastening portion in a state where the end of the locking plate is spaced apart from the locking body such that the end of the locking plate is moved independently from the locking plate when the at least one locking unit is moved in the unlocking direction by the external force in the unlocking direction.

17. The door locking apparatus as claimed in claim 15, wherein the first fastening portion and the second fastening portion are formed with a first bolt fastening hole and a second bolt fastening hole, respectively, the first bolt fastening portion and the second bolt fastening portion facing each other, wherein the locking plate is formed with a bolt hole allowing a fastening bolt passing through the first bolt fastening hole to pass through the bolt hole and to be fastened to the second bolt fastening hole, and wherein the bolt hole is formed with a shift space to allow the fastening bolt to be moved in the unlocking direction when the at least one locking unit is moved in the unlocking direction by the external force in the unlocking direction.

18. An enclosure comprising:

a body frame having an accommodation space formed within;

a door rotatably coupled to the body frame to open/close the accommodation space; and the door locking apparatus according to claim 1 installed in the door to lock or unlock the door in relation to the body frame.

19. An enclosure comprising:

a body frame having an accommodation space formed within;

a door rotatably coupled to the body frame to open/close the accommodation space; and the door locking apparatus according to claim 11 installed in the door to lock or unlock the door in relation to the body frame.

* * * * *